US005865668A

United States Patent [19]

Stewart

[11] Patent Number: 5,865,668

[45] Date of Patent: Feb. 2, 1999

[54] SHAPER HEAD FOR MAKING MOULDINGS

[76] Inventor: Ronald Stewart, Rte. 1 Box 43, Leeds, N.Y. 12451

[21] Appl. No.: 741,254

[22] Filed: Oct. 30, 1996

[51] Int. Cl.[6] ..... B24D 9/00

[52] U.S. Cl. ..... 451/28; 451/58; 451/541; 451/545; 451/544; 451/913

[58] Field of Search ..... 451/28, 58, 358, 451/540, 541, 542, 543, 544, 545, 546, 547, 913

[56] References Cited

U.S. PATENT DOCUMENTS

| | | | |
|---|---|---|---|
| 3,364,630 | 1/1968 | Rusk et al. | 451/541 |
| 3,919,811 | 11/1975 | Hedelin | 451/540 |
| 4,768,902 | 9/1988 | Rutschle et al. | 451/457 |
| 4,977,709 | 12/1990 | Siden | 451/541 |
| 5,020,282 | 6/1991 | Okajima et al. | 451/541 |
| 5,190,568 | 3/1993 | Tselesin | 451/540 |
| 5,609,518 | 3/1997 | Lucchesi | 451/541 |
| 5,662,515 | 9/1997 | Evensen | 451/59 |

*Primary Examiner*—Eileen P. Morgan

[57] ABSTRACT

This invention relates to a shaper head or rotating matrix which can be used in a process for manufacturing decorative mouldings by contacting a stock material to the rotating shaper head or matrix, such that the shaper head or matrix removes stock material. The resulting moulding is a relief of or has a negative surface in relation to the shaper head. The shaper head is a rotatable matrix comprising an axis and an exterior surface wherein the plane through the exterior surface and normal to the axis is circular and wherein at least two or more of said planes are characterized by different radii and an attaching mechanism for attaching the matrix to a source of rotary motion through the axis of the matrix. The invention also includes a process for manufacturing the mouldings and the mouldings produced by the process.

14 Claims, 2 Drawing Sheets

SHAPER HEAD FOR MAKING MOULDINGS

BACKGROUND OF THE INVENTION

Mouldings are frequently used in decorative applications, including crown mouldings and ceiling mouldings. These mouldings are traditionally made of wood and are manufactured by subjecting wood stock to a rotationally mounted shaper head, the shaper head being characterized by a number of knives. This method has disadvantages in that the machine is difficult to use and can be dangerous, particularly to the unskilled operator, such as a homeowner.

Wood mouldings also have the disadvantage in that the mouldings are generally not pliable, rendering applications requiring curves and compound angles (such as along a sweeping or curved staircase or and arch) difficult. In such instances, it is generally required to manufacture several pieces of mouldings which must be pieced together upon installation. It is often difficult to match the lines of a complex moulding, such as a crown moulding, even for a highly skilled wood worker. Furthermore, wood mouldings are also known to shrink and expand undesirable before and after manufacturing and even upon installation.

Mouldings made of plastics and resins have also been made. However, these mouldings are generally made by a cast or injection moulding process. Unfortunately, these processes require expensive machinery and are not well suited for the average homeowner. Furthermore, the mouldings prepared by such processes, in that they are also not pliable, often have the same difficulties as wood mouldings, discussed above.

As such, there exists a need for a process for manufacturing mouldings which is safe for the operator and easily adapted to machines found in many home wood working shops. There is also a need for affordable mouldings with improved pliability and flexibility for complex applications.

SUMMARY OF THE INVENTION

This invention relates to the unexpected discovery that materials, such as styrofoam, can be readily shaped into decorative mouldings by contacting a stock material to a rotating shaper head or matrix, such that the shaper head or matrix removes stock material. The resulting moulding is a relief of or has a negative surface in relation to the shaper head. The shaper head is a rotatable matrix comprising an axis and an exterior surface wherein the plane through the exterior surface and normal to the axis is circular and wherein at least two or more of said planes are characterized by different radii and an attaching mechanism for attaching the matrix to a source of rotary motion through the axis of the matrix. The shaper head differs from moulding shaper heads employed in manufacturing wood mouldings in that the shaper head is not made of a series of knives to cut or remove wood. The shaper head essentially "sands" or abrasively removes the excess stock material to achieve a contoured or shaped moulding.

The invention further relates to a rotary machine comprising a source of rotary motion and the matrix or shaper head rotatably mounted through the axis of the matrix. The rotary machine can be a drill press, a table saw, a radial arm, disc sander and a belt sander, for example.

In another embodiment, the invention includes a method for manufacturing or preparing mouldings comprising contacting a stock material, such as styrofoam, to a rotating matrix of the invention, thereby removing excess stock material and obtaining a contoured moulding corresponding to the negative or relief of the shaper head.

DETAILED DESCRIPTION OF THE INVENTION

As set forth above, the rotatable matrix or shaper head removes excess stock material, thereby shaping the stock material into a moulding, through abrasion. The terms "shaper head" and "rotatable matrix" are employed herein interchangeably. The resulting moulding is a relief of or has a negative surface in relation to the shaper head. The mouldings, and accordingly, the shaper heads, which are produced by, or used in, the process of the invention can possess many profiles. The profile of the shaper head is defined herein by the line established by the exterior surface of the shaper head in a plane drawn through the axis of the shaper head. This line is preferably complex or non-linear, such as curvilinear. A "complex" line is defined herein to mean a combination of two or more arcs (concave or convex of a single or multiple radii), lines (of the same or different lengths) and/or angles (obtuse or acute). That is, a complex line is not a straight line (as may occur in a cylinder, cone or vee) or a simple arc (as may occur in a sphere or ball). Generally, the shaper head is between about 4 cm. to about 15 cm. in diameter (the largest or smallest diameter) and about 2 cm. to about 25 cm. in length.

Figure 1:
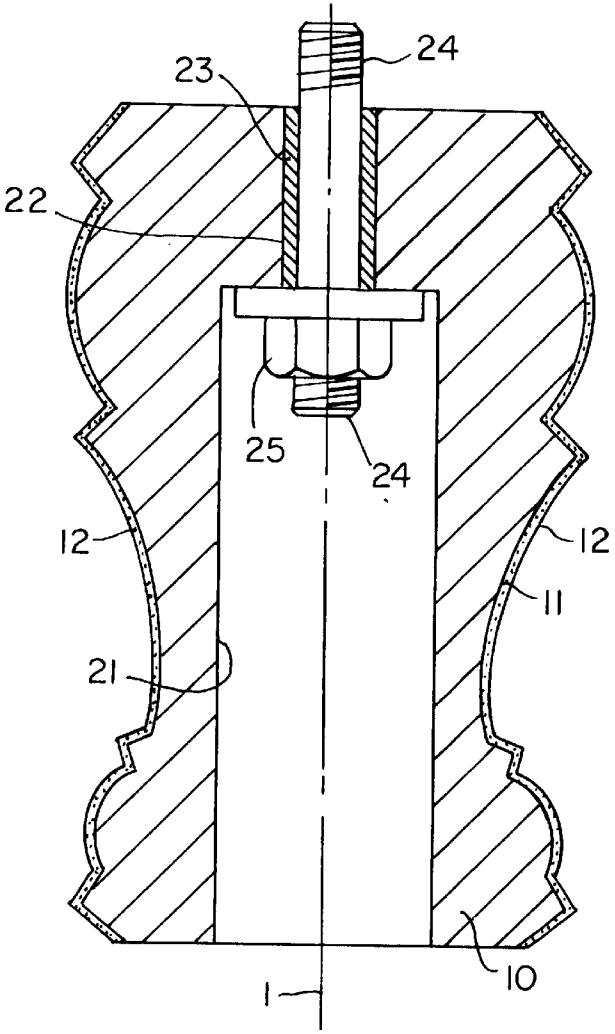
FIG. 1 illustrates a cross section of the shaper head or rotating matrix of the invention.

Turning to FIG. 1, illustrating a cross-section of the shaper head or rotating matrix 10 along its axis 1, the rotating matrix 10 has a complex line or profile 11 established by the exterior surface of the matrix in the plane of this cross-section.

The moulding which results from contacting a stock material with a particular rotating shaper head will possess the relief or negative profile of the shaper head. The profile of the moulding is defined herein by the line established by the exterior surface of the moulding which has been contacted with the shaper head in a plane drawn normal to the exterior surface of the moulding. The moulding itself, or the stock material from which it is made, can be straight or linear of varying lengths, such as between about 15 cm. to about 5 m. or more, depending upon the application. The moulding can also be non-linear. One example of a non-linear moulding is an arc which can be installed above a doorway or in a picture frame. Other examples include closed shapes such as circles, ovals, ellipses and rectangles, which can be used in framing applications.

As set forth above, the shaper head essentially "sands" or abrasively removes the excess stock material to achieve a contoured or shaped moulding. This can be achieved, for example, by manufacturing the shaper head or rotatable matrix out of an abrasive material. Examples of such materials include aluminum with a rough, knurled finish. It is preferable that the abrasiveness or grit of the material be substantially uniform to improve the quality of the final product. As such, it may be desirable to manufacture the shaper head out of one material and coat it substantially evenly with an abrasive. Examples of materials which can be coated with an abrasive include wood, resilient polymer or resins, such as polyurethanes. In yet another embodiment and, preferably for processes of limited duration (or short runs), plaster of Paris can be used. The head can be cast or molded into the desired shape. To decrease or minimize wear of the shaper head, the material should be hard and durable. The shaper head can then be coated with an abrasive. Suitable abrasives include, for example, silicas, sand, carborandum dust and garnet grit. The grit of the abrasive can range from between about 80 to about 400, as that term is defined in standardizing sandpapers. In general, the finer the grit, the smoother the resulting moulding. In employing a lower grit, more material can be removed with a single "pass" by the shaper head, as will be explained below in more detail. As such, it may be desirable to manufacture two or more shaper heads with an identical profile, differing in the grit.

Returning to FIG. 1, the abrasive coating 12 is substantially evenly distributed over the surface 11 of the matrix 10.

In conducting the process of the invention, the shaper head is attached to a source of rotation or rotary motion through its axis. As such, another embodiment of the invention includes a rotary machine comprising a source of rotary motion and the matrix or shaper head rotatably mounted through the axis of the matrix. The source of rotary motion can be a drill press, a table saw, a radial arm, router, disc sander and a belt sander, for example. Rotary machines are commercially available from a variety of sources, such as Sears Roebuck, Rockwell Delta, Atlas, and Grizzly. Preferably, the rotary machine is powered by an electric motor having between about ¼ to about 1½ horsepower. The shaper head can be permanently mounted on the rotation source or can, preferably, removably mounted. In the latter embodiment, the shaper head can be attached to the rotation source through an arbor, such as illustrated in FIG. 1. The arbor itself can be removably or permanently mounted to the matrix. Alternatively, the shaper head can include a female threaded or unthreaded section or shaft (such as a steel shaft) into which a corresponding male thread, bolt or screw can be received and fixed, wherein the male section is permanently or removably mounted into the source of rotation. The shaft can be, for example, between about 1 cm. to about 5 cm. in length and about 1 cm. to about 2 cm. in diameter. As such, the "attaching mechanism" for mounting or attaching the matrix to the source of rotary motion is intended to include a variety of materials or configurations which possess the result of fixing the shaper head to the source of rotation. Perhaps in it simplest embodiment, the attaching mechanism is simply a borehole through the axis characterized by two distinct diameters permitting the receiving of (1) a bolt or arbor through the narrower diameter and (2) a nut, which can be tightly attached to the threaded section of the bolt or arbor through the wider diameter. Alternatively, the attaching mechanism can include the fixed arbor.

FIG. 1 exemplifies an embodiment wherein a borehole 22 with a steel shaft 23 is capable of receiving an arbor 24 which extends into borehole 21 of a greater diameter than shaft 23. The arbor 24 is anchored or secured to the matrix by a complementary threaded nut 25 fitting into borehole 21 and onto the arbor 24.

Figure 2:
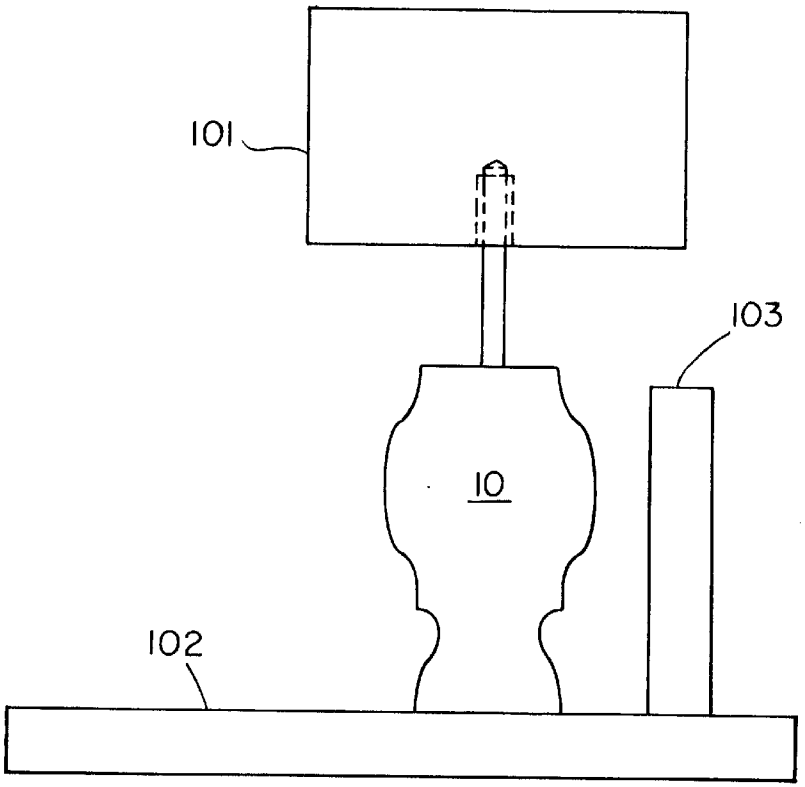
FIG. 2 illustrates the shaper head of the invention attached to or mounted on a drill press.

FIG. 2 exemplifies the rotating matrix 10 attached to a drill press 101 through arbor 24 which is directed through the axis of the matrix 10. In this drawing, the rotation is clockwise (as viewed from the top) around the axis of the matrix 10.

In this preferred embodiment, the rotational machine further comprises a surface 102 for supporting a stock material normal to the axis of the abrasive head. Such a surface is generally found on commercially available machines for which the invention can be adapted, such as a drill press 101, a table saw, a radial arm, a router, or a jig saw. The stock material can then be rested or supported upon this surface and moved past the rotating matrix. The machine can further comprise an adjustable fence, swing or guide 103 normal to said surface. The fence ensures that the matrix is contacted with the stock material at a consistent depth. The fence or swing is generally adjusted to a desired distance from the axis of the matrix and the stock material is passed between them, thereby determining the thickness of the resulting moulding. In contrast to conventional shapers for wood mouldings, the stock material passes between the fence and the rotating shaper head against the rotation. This ensures that the depth or amount of material is consistently removed along its length with each contact of the stock material and rotating matrix.

Figure 3:
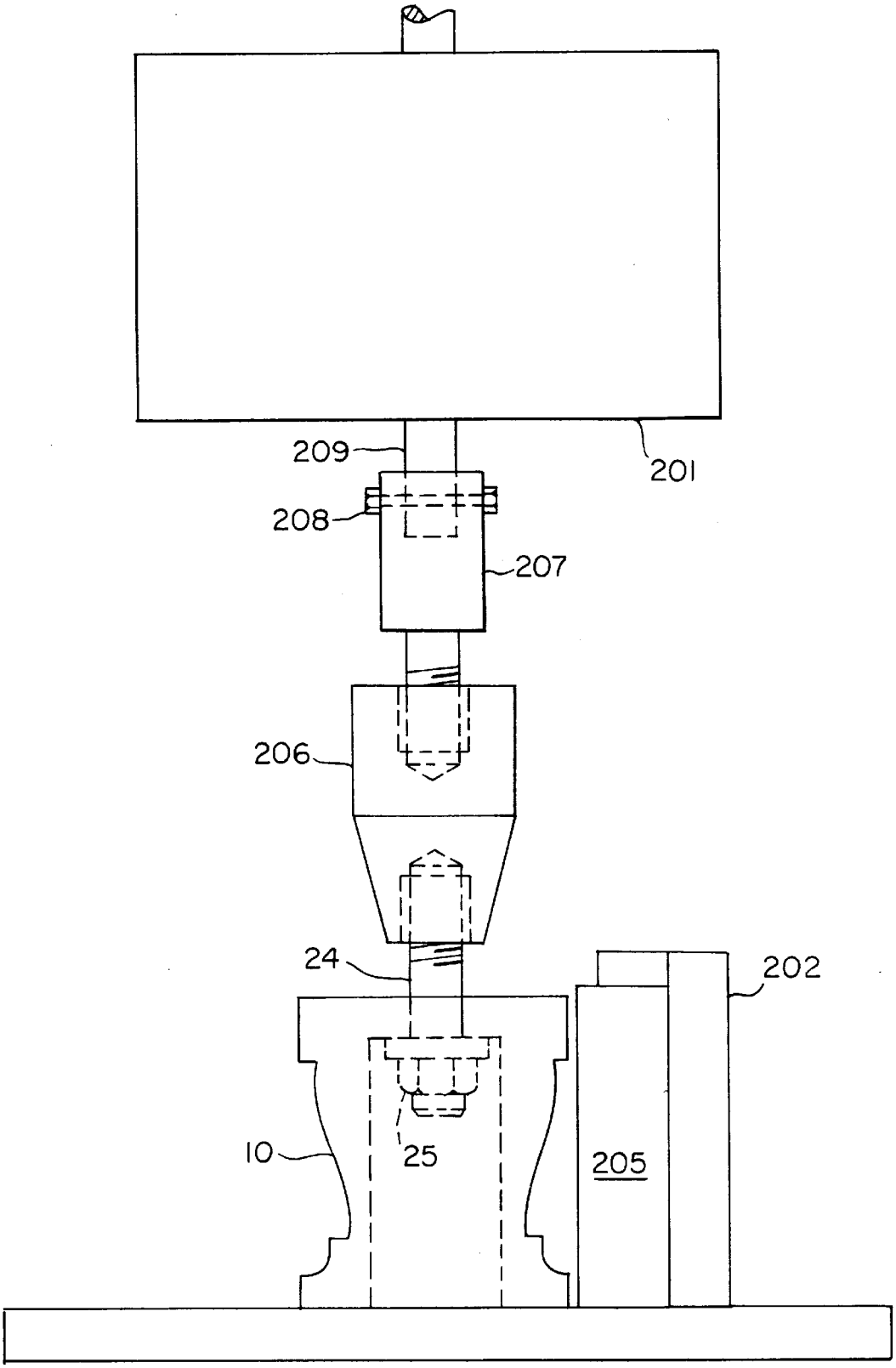
FIG. 3 illustrates the shaper head of the invention attached to or mounted on a radial arm saw.

Referring to FIG. 3, the rotating matrix 10 is attached to an electric motor 201 with a rotating primary arbor 209, such as that of a table saw, through arbor 24, chuck 206 and a second arbor 207, which is, in turn, secured by a pin 208. The attachment is directed through the axis of the matrix 10. The rotational machine further comprises a surface 202 for supporting a stock material parallel to the axis of the abrasive head. The surface 202 can be adjusted to the desired depth. The stock material 205 is then passed between the surface 202 and the matrix 10.

In another embodiment, the matrix is attached to source of rotary motion which is then moved along the stock material which is maintained in an essentially stationary position relative to the rotational machine. Examples of sources of rotary motion which can be readily adapted to the present invention are routers and dremmels. The machines can be hand-held, which is particularly advantageous for the home-owner. In this embodiment, moving the router or dremmel over the stock material can advantageously be used for free hand "carving" or along a straight edge for flutes or grooves when required. In another embodiment, the router or dremmel can be attached to a first end of a board or other linear arm with the opposing end fixed in a pivotal fashion. In this manner, the stock material can be fluted, carved or shaped in an arc of a radius corresponding to the distance between the router and fixed point. Alternatively, the machine can be operated remotely, as in a robotics application.

In another embodiment, the invention includes a method for manufacturing or preparing mouldings comprising contacting a stock material (e.g., along its length) to a rotating matrix of the invention (described above), thereby removing excess stock material and obtaining a contoured moulding corresponding to the negative or relief of the shaper head. Improved results are seen where the excess stock material is removed incrementally by contacting or passing the stock material against the rotating matrix multiple times. In shaping a material such as styrofoam, typically between about 2 to about 4 or about 6 passes result in a smooth moulding.

Generally, the matrix can be rotated at a speed of at least about 600 rotations per minute (rpm), preferably between about 1,500 to about 5,000 rpms. It may be desirable to employ a source of rotation wherein the rotation speed is adjustable, such as in a drill press.

The stock materials which can be employed in the employed invention include polymeric foams and other resins, such as styrofoam, polyurethane and polypropylene. One example of a stock material which is commercially available include a styrofoam insulation material called Blue board manufactured by Dow Corning. Another insulation board which can be used in this process is called "Bead board", also manufactured by Dow Corning.

The mouldings manufactured according to the claimed invention can be installed employing an adhesive, such as a caulking adhesive (e.g., Liquid Nails™ adhesive) and/or nails. Ceramic tile and linoleum adhesives can also be employed for installation. To join two or more pieces of foam together, it is desirable to employ an adhesive such as Touch n' Stick™ adhesive (Clayton Corporation, Yenton, Mo.), a spray adhesive which is readily applied in a thin layer and provides a positive bond between polymeric foam resins. In this embodiment, two or more pieces of resin can be joined to increase the length, width or depth, before or after shaping as described herein. Nail holes, dents or open joints can be filled with a latex filler, such as Dap™ filler. The mouldings can be treated with a hardening agent or coating to decrease damage to the mouldings. Furthermore, the mouldings can be painted, embossed, or finished to imitate the appearance of wood or stone. The mouldings can further be hand carved.

The mouldings can be employed in a number of applications. In addition to crown mouldings and other ceiling mouldings, as discussed above, the mouldings of the claimed invention can be used to manufacture panellings with improved thermal and acoustical properties. Additionally, columns (e.g., fluted columns), pediments, entablatures and picture frames can be made.

In view of the flexibility of mouldings manufactured from foam resins, such as styrofoam, the mouldings can be readily conformed to otherwise difficult applications. In one example, a linear moulding made from Dow Corning blue board styrofoam (1 inch thick, 2½ inches wide) was bent round a 24 inch cylinder. Upon applying a heat with a hairdryer to the moulding, the moulding bent around an 8 inch cylinder. In yet another embodiment, a similar moulding was bent around a cylinder in a spiral fashion. This could not be achieved by a wood moulding of similar dimensions. Such an application traditionally would require the manufacture of several smaller wood mouldings, which upon piecing together arrive at a complex configuration. The resulting product will have several seams or joints which are very likely to be noticeable. Furthermore, such an undertaking generally exceeds the skill of the home-owner, requiring the contracting of a highly skilled professional woodworkers. The present invention decreases the expense associated with complex mouldings and simultaneously improves its appearance in avoiding joints along its length.

In yet another embodiment, the mouldings of the present invention can be employed to make a cast or mold for, for example, plaster.

Those skilled in the arts will recognize or be able to ascertain using no more than routine experimentation many equivalents to the specific embodiments of the invention described herein. Such equivalents are intended to be encompassed in the scope of the following claims.

I claim:

1. A method for shaping a polymeric foam material comprising the steps of contacting the material with a rotary machine comprising a source of rotary motion and a rotatable matrix, wherein the rotatable matrix comprises an axis and an abrasive exterior surface wherein the exterior surface plane normal to the axis is circular and wherein the abrasive exterior surface of the matrix is characterized by a curvilinear profile and wherein the rotatable matrix is rotating at a speed of at least about 600 rotations per minute.

2. The method of claim 1 wherein the polymeric foam material is styrofoam.

3. The method of claim 1 wherein the polymeric foam material is shaped to the relief of the curvilinear profile.

4. The method of claim 1 wherein the polymeric foam material is moved against the rotation of the rotatable matrix.

5. The method of claim 1 wherein the abrasive exterior surface has a grit between about 80 to about 400.

6. The method of claim 1 wherein the rotatable matrix is rotating at a speed between about 1500 and about 5000 rotations per minute.

7. The method of claim 1 wherein said rotatable matrix is removable from the source of rotary motion.

8. The method of claim 1 wherein said source of rotary motion is selected from the group consisting of a drill press, a table saw, a radial arm saw, a router, a saw disc sander and a belt sander.

9. The method of claim 8 wherein said source of rotary motion further comprises a surface for supporting the polymeric foam material.

10. The method of claim 9 wherein the source of rotary motion further comprises an adjustable fence or guide normal to the surface.

11. The method of claim 10 wherein the polymeric foam material is moved between the adjustable fence or guide and the rotatable matrix.

12. The method of claim 11 wherein the polymeric foam material is moved against the rotation of the rotatable matrix.

13. The method of claim 12 wherein the rotatable matrix is rotating at a speed between about 1500 and about 5000 rotations per minute.

14. The method of claim 13 wherein the abrasive exterior surface has a grit between about 80 to about 400.

* * * * *